United States Patent [19]

Achen

[11] 4,192,362

[45] Mar. 11, 1980

[54] PAINT MIXING TABLE

[76] Inventor: John J. Achen, P.O. Box 5287, Yuma, Ariz. 85364

[21] Appl. No.: 941,145

[22] Filed: Sep. 11, 1978

[51] Int. Cl.[2] ..... B65B 43/54

[52] U.S. Cl. ..... 141/177; 141/378; 211/1.5; 269/56

[58] Field of Search ..... 105/26 R, 30, 49; 141/84, 102, 129, 155, 163, 167, 177, 283, 284, 378; 198/485, 339, 750; 211/1.5; 269/56, 57

[56] References Cited

U.S. PATENT DOCUMENTS

| | | | |
|---|---|---|---|
| 1,072,290 | 9/1913 | Wood et al. | 141/177 |
| 3,929,173 | 12/1975 | Mauroner | 141/284 X |
| 4,049,031 | 9/1977 | Cooper et al. | 141/284 |

*Primary Examiner*—Frederick R. Schmidt
*Attorney, Agent, or Firm*—Cahill, Sutton & Thomas

[57] ABSTRACT

An incrementally positionable reciprocating conveyor mounted tray serially positions each of a plurality of containers beneath a dispensing unit for dispensing a predetermined material and quantity thereof into each of the containers.

2 Claims, 3 Drawing Figures

PAINT MIXING TABLE

The present invention relates to conveyors and, more particularly, to conveyors for positioning a plurality of containers to receive dispensed materials from a dispensing unit.

Paint manufacturers manufacture and distribute paint to their wholesale and retail outlets in one or five gallon containers. The number of colors manufactured and available for distribution to the outlets is relatively small, being limited to basic colors from which additional colors may be obtained by adding specified quantities of one or more pigments. The outlets, whether wholesale or retail, blend the paints received with one or more pigments to offer a wide range of established colors and shades thereof; customized colors and shades can, of course, be blended upon specific request.

Presently, most paint outlets blend, by hand, the colors desired by adding one or more pigments. This process is accomplished by dispensing the pigment(s) from individual containers of pigment or from a dispensing apparatus which dispenses, in determinable quantities, any one of several pigments. Because of the nature of the apparatus employed, each can of paint to be blended must be handled individually. Such handling is necessarily very time consuming and often results in substantial color variations within a group of cans which are intended to contain the same color or shade of paint.

In the field of canned and bottled goods, there exists apparatus and machinery for dispensing predetermined quantities of materials, whether liquid or solid, into each of a plurality of containers. Such machinery, however, is only economically useful in mass production environments and is not feasible for use wherein a plurality of ingredients are to be mixed in a relatively small number of containers. U.S. Pat. No. 2,778,389, describes a multiple receptacle filling apparatus which might be employed in the mass production environment described above.

Over the years, various conveyors have been developed for transporting goods from one location to another. In some applications, materials are dispensed into containers transported on the conveyor. Various conveyor apparatus useful in these applications are described in U.S. Pat. Nos. 2,018,360, 2,970,682; 3,915,442, 4,037,714.

In the present invention, a tray is moveably mounted upon a conveyor mechanism and positionable in operative engagement with a pigment dispensing unit. A driving and control assembly incrementally and reciprocally positions the tray with respect to the dispensing unit. Thereby, by serially placing a plurality of containers upon the tray, each container is sequentially locatable beneath the dispensing unit to receive a quantity of the dispensed material.

It is therefore a primary object of the present invention to provide a conveyor apparatus for incrementally locating a container supporting tray at a predetermined location during reciprocal movement of the tray in either of two opposed directions.

Another object of the present invention is to provide apparatus for incrementally and sequentially transporting in either of two opposed directions containers past a predetermined location.

Still another object of the present invention is to provide apparatus for sequentially positioning each of a plurality of paint containers beneath a pigment dispensing unit.

A further object of the present invention is to provide apparatus for blending paint in each of a plurality of paint containers.

A still further object of the present invention is to provide a method for sequentially positioning each of a plurality of containers at a predetermined location upon travel of the containers in either of two opposed directions.

A yet further object of the present invention is to provide a method for uniformly blending paint in a plurality of containers.

These and other objects of the present invention will become apparent to those skilled in the art as the description thereof proceeds.

The present invention may be described with greater specificity and clarity with reference to the following drawings, in which.

At paint outlets, whether wholesale or retail, a customer may select a color or shade of paint from a color chart or he may desire a custom blend. Unless the color selected is one of a relatively limited number of colors manufactured and distributed to the outlet, the outlet will, in accordance with predetermined formulas, add the necessary pigments to a basic color to obtain the color or shade desired. The resulting blending is performed by manually adding to each can of paint ordered, the number and quantity of pigments specified by formula. This process of obtaining a blend is extremely time consuming and unless the person performing the blending is very conscientious, variations in color between several cans containing the blend will result.

As the apparatus used by paint manufacturers who mix or blend paint on a mass production basis is far to expensive for use in paint outlets, the operators of paint outlets have previously had no choice but to perform the paint blending by tedious manual processes. The present invention, however, was developed for the purpose of providing semi-automated apparatus for adding uniform quantities of pigment to a given number of paint containers.

Figure 1:
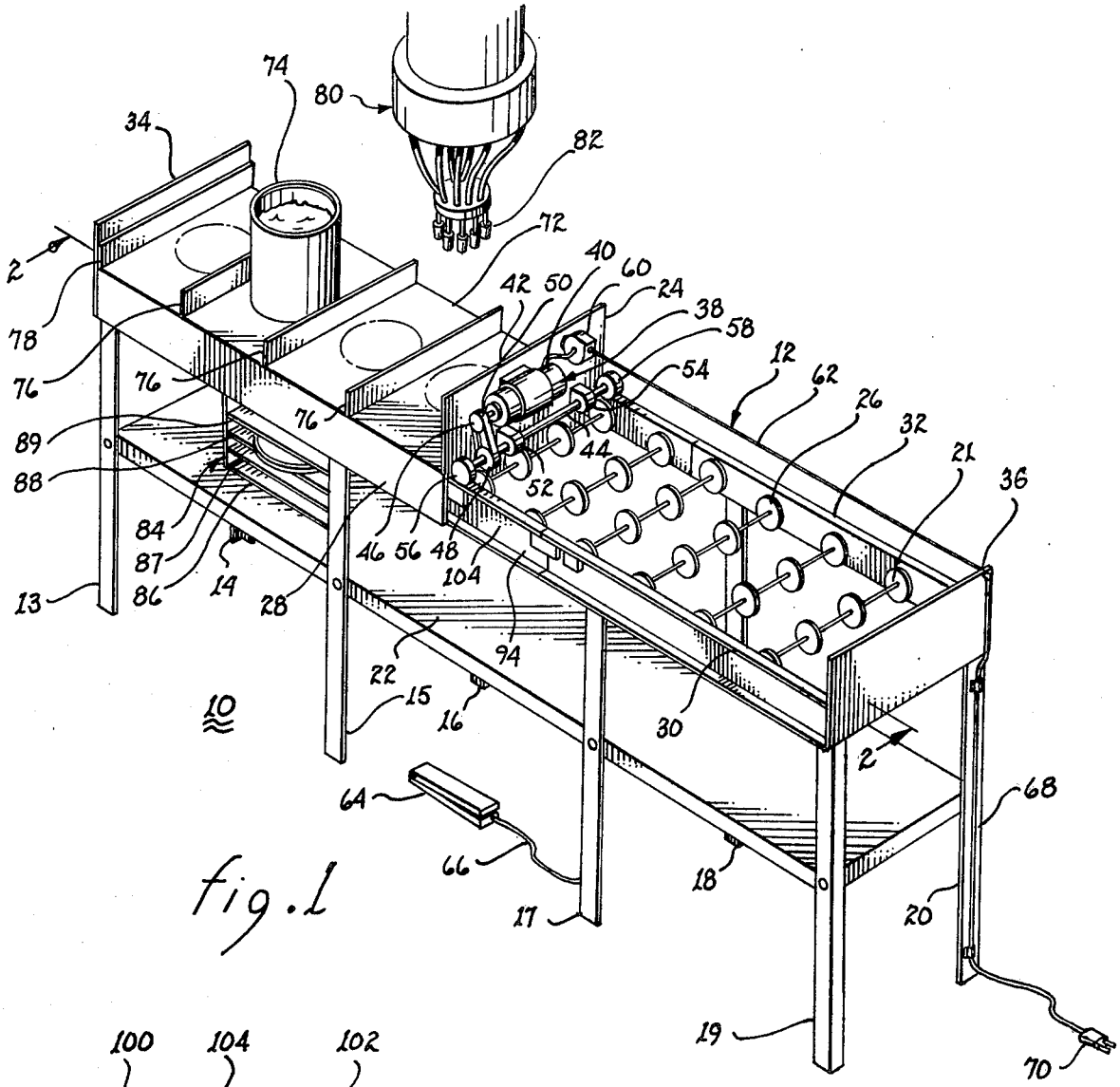
FIG. 1 is a perspective view illustrating a conveyor apparatus for incrementally positioning a plurality of paint containers.
Figure 2:
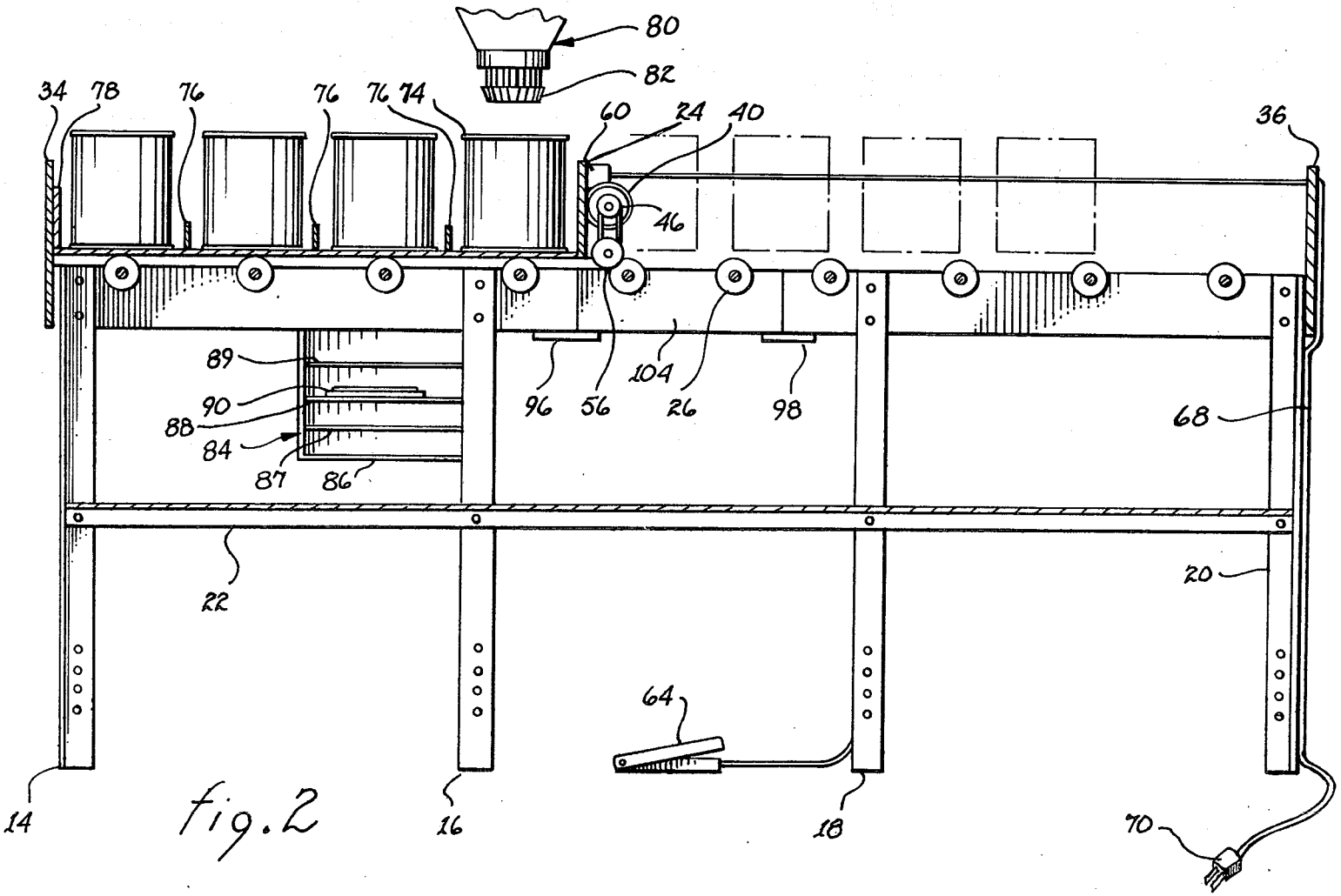
FIG. 2 is an elevational view taken along lines 2—2, as shown in FIG. 1.

Referring to FIGS. 1 and 2, there is shown a table 10 having a conveyor apparatus 12 supported by a plurality of legs 13, 14, 15, 16, 17, 18, 19, and 20. A shelf 22 may be attached to the legs for storage of various items ancillary or attendant to the use of table 10.

Conveyor apparatus 12 includes a tray 24 translatable in either direction upon a conveyor 21. The conveyor includes rotatably mounted discs 26 for low friction locomotion of the tray thereupon; other low friction support elements, such as rollers, ball bearings and the like could be substituted to perform the function of discs 26. Downwardly depending flanges 28, disposed along the longitudinal edges of tray 24, cooperate with side rails 30 and 32 of conveyor 21 to maintain the tray aligned with the conveyor. End plates 34 and 36 preclude travel of tray 24 off the ends of the conveyor.

Translation of tray 24 in either direction upon conveyor 21 is achieved by actuation of drive means 38. The drive means includes an electric motor 40 mounted upon member 42 of tray 24 to rotatably drive a shaft 44 through pulleys 46 and 48 connected by belt 50. It is to be understood that chain and sprocket means or the like could be similarly used to transfer rotary motion from the output shaft of motor 40 to shaft 44. Shaft 44 is rotatably supported by pillow blocks 52 and 54 attached upon member 42. Wheels 56 and 58 are mounted upon shaft 44 for engagement with side rails 30 and 32. It is to be understood that sufficient traction exists between these wheels and the side rails to produce translatory motion of tray 24 upon energization of motor 40. Moreover, wheels 56, 58 and side rails 30, 32 may be replaced by gears and toothed racks, respectively, or the like.

Incremental movement of tray 24 along conveyor 21 is achieved by selective energization and de-energization of motor 40 through either automated or manual switch means, such as switch assembly 60.

To obtain reciprocal translation of tray 24 upon conveyor 21, means are provided to change the direction of rotation of shaft 44. Such means include a switch assembly 60 electrically connected to motor 40 which switch assembly on actuation, reverses the direction of rotation of the output shaft of the motor. In one embodiment of the switch assembly, a cord 62, retractably wound upon a spool, may be attached to end plate 36 to actuate the switch assembly when tray 24 comes into contact with end plates 34 or 36. Alternatively, limit switches located along conveyor 21 and cooperating with movement of tray 24 therepast may be employed to control the direction of rotation of the output shaft of motor 40. Moreover, such cord or limit switches may regulate the energization and de-energization of the motor to obtain incremental movement of the tray.

To initiate stop and/or regulate translational movement of tray 24, a foot pedal 64 may be incorporated. The foot pedal may include one or more separately actuatable switches to provide full control over the operation of motor 40. A cord 66, housing the necessary number of electrical conductors, interconnects foot pedal 64 with the electrical apparatus to be energized by the foot pedal.

An electrical conductor 68, terminating in a plug 70, is connected to a source of electrical power and transmits electrical power to the various electrical components of table 10.

Tray 24 includes a surface 72 for supporting a plurality of containers, such as paint cans 74. The positioning of these paint cans upon the table is determined by a plurality of upwardly vertically extending dividers 76. These dividers, in combination with member 42 and wall 78 preclude unwanted movement of the paint cans along the longitudinal axis of tray 24 due to rapid incremental translatory movement of the tray. Additionally, in the event tray 24 is automatically incrementally and reciprocally repetitively repositioned along conveyor 21 with respect to a fixed point (as will be discussed in more detail below) the paint cans must be accurately positioned upon the tray; such positioning is effected by dividers 76.

A pigment dispensing unit 80 is located above table 10 in general vertical alignment therewith. Unit 80 may include a plurality of nozzles 82, each of which are connected to a separate pigment source. Valve means are incorporated for controlling the flow of pigment through each nozzle. Means may also be incorporated in unit 80 to regulate the quantity of pigment dispensed per operation of the attendant valve means. Thereby, the selection and quantity of pigment dispensed into each paint can 74 is controllable. It is to be understood that the pigment dispensing unit may be manually operated or it may be automated in response to actuation of foot pedal 64 or similar switching device.

Table 10 may include a shelf assembly 84 depending from conveyor 21 or supported upon shelf 22. Shelf assembly 84 temporarily houses upon shelves 86, 87, 88 and 89 the lids for each of paint cans 74 disposed upon tray 24. Preferrably, the shelves slant rearwardly downwardly to facilitate insertion of the lids and the shelves are of less depth than the diameter of the lids to render access to the lids convenient.

The operation of conveyor apparatus 12 will be described with particular reference to FIG. 2. When the paint in one or more paint cans 74 is to be blended with a quantity of pigment or pigments, the paint cans are placed upon tray 24. Prior thereto, the tray is positioned at the left most point on conveyor 21, as shown. On actuation of the valve means in pigment dispensing unit 80, a quantity of each pigment to be dispensed drops from the respective nozzle 82 into paint can 74. This operation may be performed manually or automatically by actuation of appropriate switch means. On termination of pigment dispensation into the first paint can, foot pedal 64 is actuated, which actuation energizes motor 40 resulting in translation of tray 24 to the right for an incremental distance commensurate with the distance between the first and second paint can. At this location, pigment dispensing assembly 80 is once more actuated to dispense pigment into the second paint can. Thereafter, the cycle is repeated until all paint cans have received pigment and tray 24 has been repositioned to the right side of conveyor 21 (as indicated in phantom lines).

Should additional pigments be added to paint cans 74, the direction of translation of tray 24 is reversed by actuation of switch assembly 60. Incremental translation of tray 24 in the opposite direction will position each of paint cans 74 in vertical alignment with pigment dispensing unit 80 to permit dispensation of additional pigments into each paint can. Thus, table 10 may be employed to dispense a single pigment into each paint can during translation in each direction of tray 24 beneath the pigment dispensing assembly. Should multiple passes of the paint cans beneath the paint pigment dispensing unit be necessary, the reciprocal movement of tray 24 permits such dispensation without manually relocating the paint cans to a starting point for each pass. On completion of the addition of the requisite pigments, each of lids 90 are removed from their respective shelves in shelf assembly 84 and mated with one of the paint cans.

Figure 3:
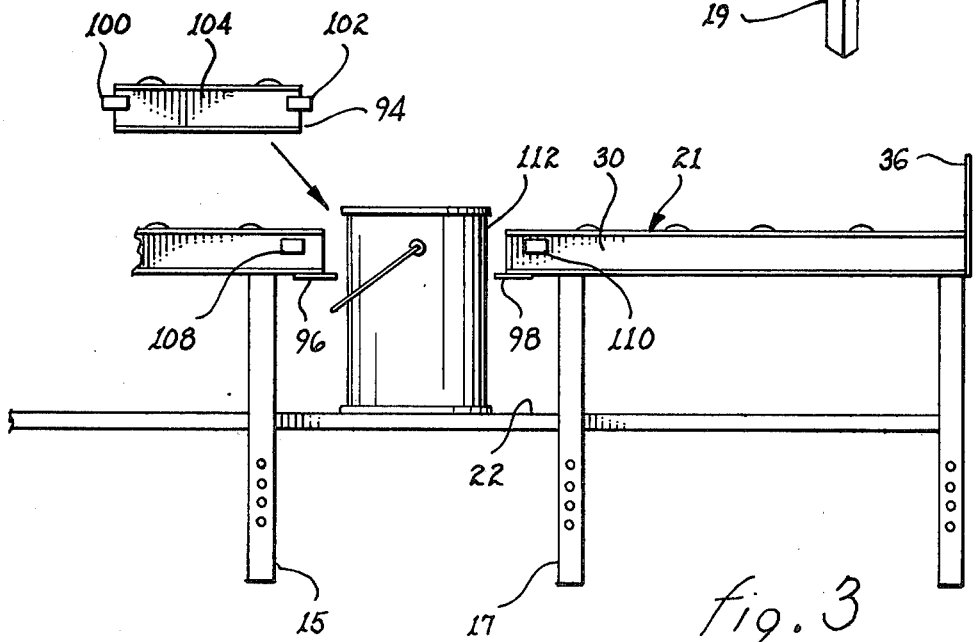
FIG. 3 illustrates a modification of the conveyor apparatus to accommodate large sized paint containers.

Since most paint outlets sell the bulk of their paint in one gallon cans, the size of table 10 may be configured primarily to accommodate these cans. Where pigments are to be added to larger cans of paint, such as five gallon cans, the embodiment of conveyor 21 illustrated in FIG. 3 may be employed. Herein, section 94 is detachably positionable as part of conveyor 21. It is supported upon lips 96 and 98 extending from abutting ends of side rails 30 and 32. Lateral displacement of section 94 is precluded by tabs 100 and 102 attached to and extending from the side surfaces of rail sections 104 and 106. These tabs mate with the lateral surface of the respective side rails. Stops, such as stops 108 and 110 may be employed to further positionally maintain section 94 in alignment with conveyor 21.

In operation, a five gallon paint can 112 is supported upon shelf 22 and extends upwardly beyond conveyor 21. By positioning pigment dispensing unit 80 vertically coincident with removable section 94, paint can 112 will be automatically located beneath the pigment dispensing unit. By appropriate dimensioning of the length of conveyor 21 commensurate with the length of tray 24, the tray need not be removed for removal of section 94. Yet, the incremental reciprocal movement of the tray, as described above, can still be maintained by appropriate actuation of the necessary electrical switches.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A table for serially locating each of a plurality of paint cans in alignment with a pigment dispensing unit for dispensing pigment into each paint can, said table comprising in combination:

(a) a tray for supporting each of the paint cans, said tray including means for locating each paint can upon said tray, said tray further including depending flanges disposed at opposed sides thereof;

(b) a conveyor having a longitudinal axis for accommodating reciprocal translatory motion of said tray with respect to the dispensing unit, said conveyor including side rails for engagement with said depending flanges to limit motion of said tray to motion along the longitudinal axis of said conveyor;

(c) drive means for imparting translatory motion to said tray with respect to said conveyor;

(d) switch means for controlling said drive means to impart incremental motion to said tray in either direction along the longitudinal axis of said conveyor;

(e) a shelf disposed beneath said conveyor for supporting a paint can; and (f) said conveyor including a removable section in general vertical alignment with both the dispensing unit and a part of said shelf;

whereby, the paint cans are serially positionable in alignment with the dispensing unit or upon said shelf to receive dispensed pigments.

2. The table as set forth in claim 1 wherein said removable section includes guide means for maintaining said removable section in alignment with said conveyor.

* * * * *